US006840795B1

(12) United States Patent
Takeda et al.

(10) Patent No.: US 6,840,795 B1
(45) Date of Patent: Jan. 11, 2005

(54) CONNECTOR

(75) Inventors: Jun Takeda, Ome (JP); Yuichi Koreeda, Hachioji (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/618,423

(22) Filed: Jul. 11, 2003

(51) Int. Cl.[7] ..... H01R 12/24
(52) U.S. Cl. ..... 439/492; 439/445; 439/456
(58) Field of Search ..... 439/492–499, 439/445–446, 456–457

(56) References Cited

U.S. PATENT DOCUMENTS 1,817,004 A * 8/1931 Hubbell, Jr. ..... 439/459
5,735,707 A * 4/1998 O'Groske et al. ..... 439/446
6,196,864 B1 * 3/2001 Huguenet ..... 439/446
6,406,314 B1 * 6/2002 Byrne ..... 439/215
6,447,315 B1 * 9/2002 Pan et al. ..... 439/165
6,644,999 B1 * 11/2003 Tan et al. ..... 439/446

FOREIGN PATENT DOCUMENTS

JP 2512513 Y2 7/1996

* cited by examiner

*Primary Examiner*—Truc T. T. Nguyen
(74) *Attorney, Agent, or Firm*—Prishauf, Holtz, Goodman & Chick, P.C.

(57) ABSTRACT

There is provided a connector which is capable of routing a flat cable in a desired arbitrary direction and at the same time preventing the flat cable from being broken. A concave portion is formed in a housing, and a convex portion is formed on a cable-holding member for being slidably fitted in the concave portion. Slits are formed in the concave portion, and projections to be engaged with the slits are formed on the cable-holding member. Thus, directions of rotations of the cable-holding member are restricted such that the cable-holding member can rotate only about a first axis extending in a direction of width of the flat cable and a second axis orthogonal to the first axis and extending in a direction of insertion of the flat cable.

16 Claims, 8 Drawing Sheets

(a)

(b)

(c)

CONNECTOR

BACKGROUND OF THE INVENTION

1. Field of the Invention

This invention relates to a connector for a so-called flat cable having a plurality of conductor wires or optical fibers arranged therein in parallel with each other and covered with sheathing.

2. Prior Art

A conventional connector for a flat cable includes a housing and a cable-holding member. One end of the flat cable is inserted into the housing. The cable-holding member is fixed to the housing with the flat cable held therein.

On the other hand, there is a connector for a cable other than the flat cable, which has a cable-holding member rotatable with respect to a housing (see e.g. Publication of Utility Model Registration No. 2512513). An end of a cable inserted into the housing is held by the cable-holding member, and the cable-holding member is rollably held by the housing.

The flat cable can be bent in the direction of thickness thereof, but not in the direction of width thereof. As described above, in the conventional connector for a flat cable, the cable-holding member simply holds the flat cable, and is fixed to the housing. Therefore, when the connector is fitted to a mating connector fixed to a casing, a direction in which the flat cable can be routed or bent is limited to the direction of thickness of the flat cable.

On the other hand, in the connector for a cable other than a flat cable, the cable-holding member can be rolled, thereby permitting the cable to be routed in a desired direction. Therefore, if this connector is employed for a flat cable, there is a fear that a cable-laying worker bends the flat cable in the direction of width thereof for routing. This sometimes causes the breaking of a conductor wire or an optical fiber within the flat cable.

SUMMARY OF THE INVENTION

It is an object of the present invention to provide a connector that permits a flat cable to be routed in a desired direction, and is at the same time capable of preventing breaking of the flat cable.

To attain the above object, the present invention provides a connector comprising:

a housing for having an end of a flat cable inserted therein;

a cable-holding member for holding the flat cable and being mounted in the housing;

a concave portion formed in the housing:

a convex portion formed on the cable-holding member and slidably fitted in the concave portion; and rotation-restricting means for restricting directions of rotations of the cable-holding member such that the cable-holding member can rotate only about a first axis extending in a direction of width of the flat cable and a second axis orthogonal to the first axis and extending in a direction of insertion of the flat cable.

This connector has the rotation-restricting means for restricting directions of rotations of the cable-holding member such that the cable-holding member can rotate only about a first axis extending in a direction of width of the flat cable and a second axis orthogonal to the first axis and extending in a direction of insertion of the flat cable. This makes it possible to orient the surface of the flat cable in a direction of routing of the flat cable. In the state, by bending the flat cable in the direction of thickness thereof, it is possible to route the flat cable in a desired direction.

Further, with provision of the rotation-restricting means, the cable-holding member is prevented from being rotated in the direction of the width of the flat cable, which makes it possible to prevent the flat cable from being improperly used, and thereby prevent breaking of the flat cable.

Preferably, the rotation-restricting means comprises at least one projection provided on one of the convex portion and the concave portion, and at least one slot provided in the other of the convex portion and the concave portion, for being engaged with the at least one projection.

According to this preferred embodiment, since the rotation-restricting means comprises at least one projection and at least one slot, the rotation-restricting means is simple in construction, which facilitates the machining of the cable-holding member and the housing, thereby making it possible to reduce manufacturing costs of the connector.

More preferably, the at least one projection is one projection and the at least one slot is one slot.

According to this preferred embodiment, since the at least one projection is one projection and the at least one slot is one slot, the construction of the rotation-restricting means can be further simplified, thereby making it possible to further reduce manufacturing costs of the connector.

More preferably, the at least one projection are two projections and the at least one slot are two slots.

According to this preferred embodiment, since the at least one projection are two projections and the at least one slot are two slots, it is possible to reliably hold an engaged state of the projections and the slots, which makes it possible to ensure stable motion of the cable-holding member.

More preferably, the at least one slot is at least one slit.

More preferably, the at least one slot is at least one groove.

More preferably, the at least one slot each comprises a first slot extending in the first axis, and a second slot extending in the second axis.

Further preferably, the first slot and the second slot are connected to form a continuous T-shaped slot.

The above and other objects, features and advantages of the present invention will become more apparent from the following detailed description taken in conjunction with the accompanying drawings.

BRIEF DESCRIPTION OF THE DRAWINGS

FIGS. 7A to 7C are diagrams showing parts of the FIG. 1 optical connector, in which:

FIG. 7A is a plan view of a slit portion of a lower housing member;

FIG. 7B is a plan view of a cable-holding member; and

FIG. 7C is a bottom view of the slit portion of the lower housing member;

DETAILED DESCRIPTION OF THE PREFERRED EMBODIMENTS

The invention will now be described in detail with reference to the drawings showing preferred embodiments thereof.

Figure 1:
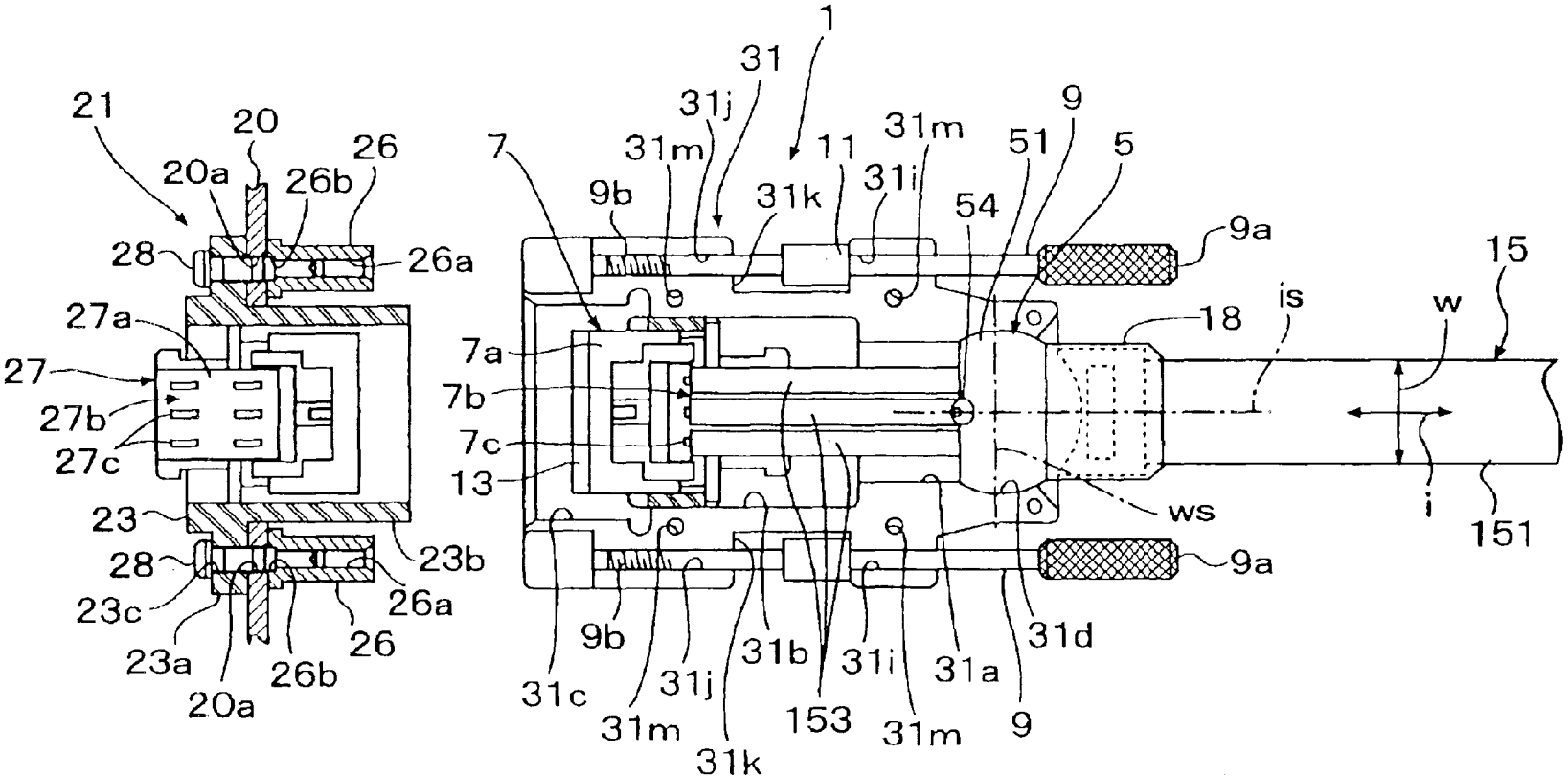
FIG. 1 is a cross-sectional view taken on line II—II of FIG. 3, which shows an optical connector according to a first embodiment of the invention in an unconnected state.
Figure 2:
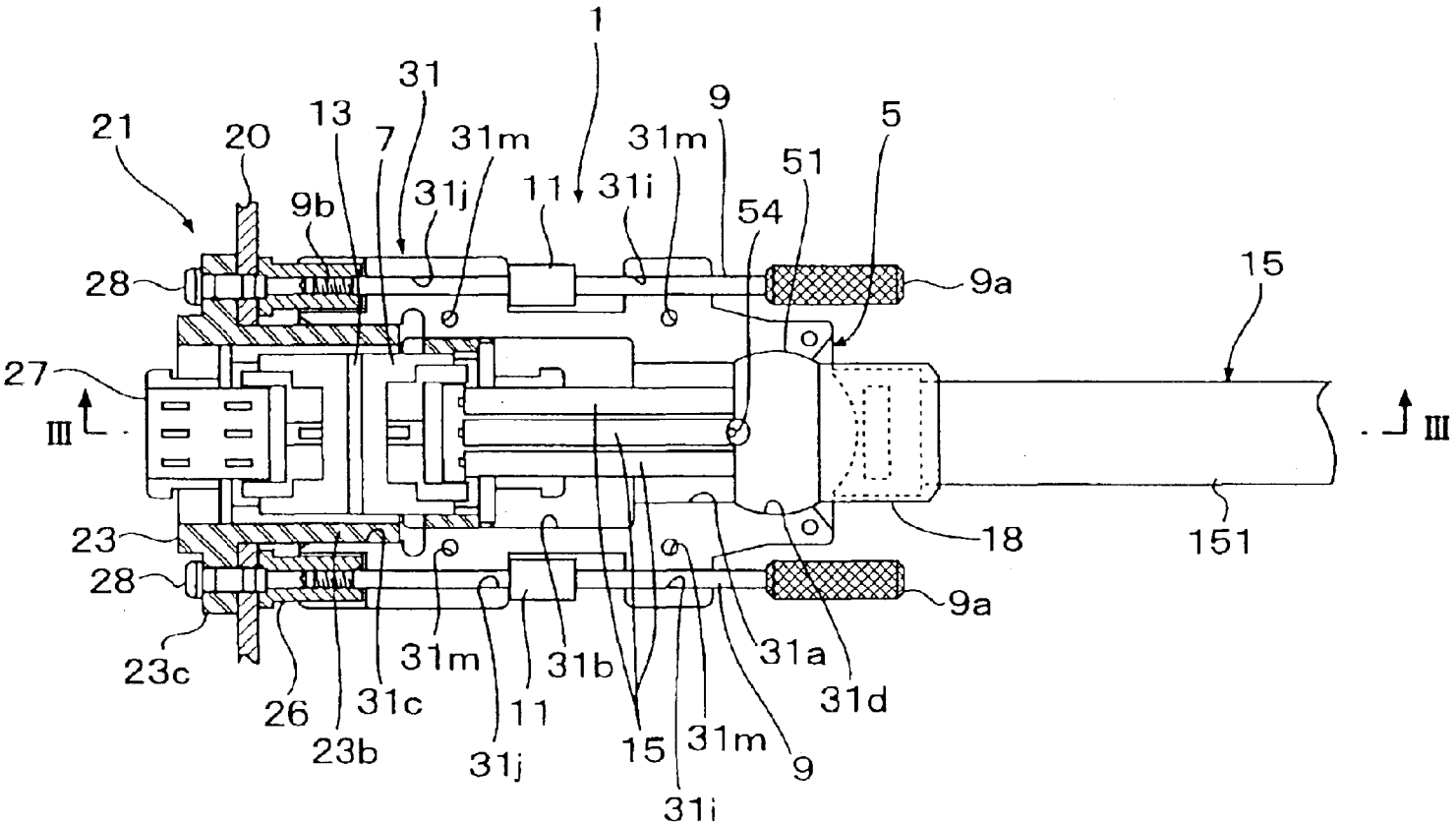
FIG. 2 is a cross-sectional view taken on line II—II of FIG. 3.
Figure 3:
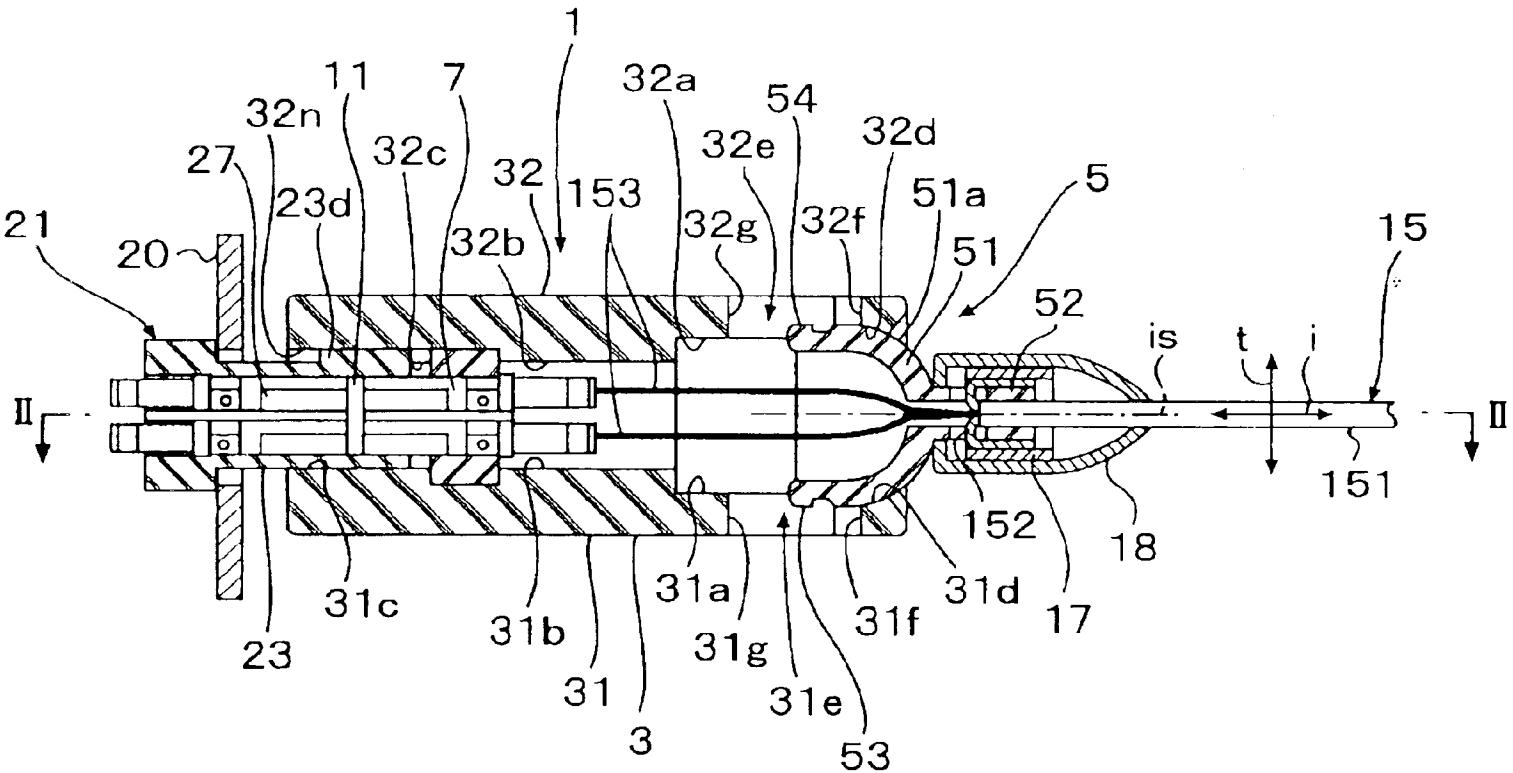
FIG. 3 is a cross-sectional view taken on line III—III of FIG. 2.
Figure 4:
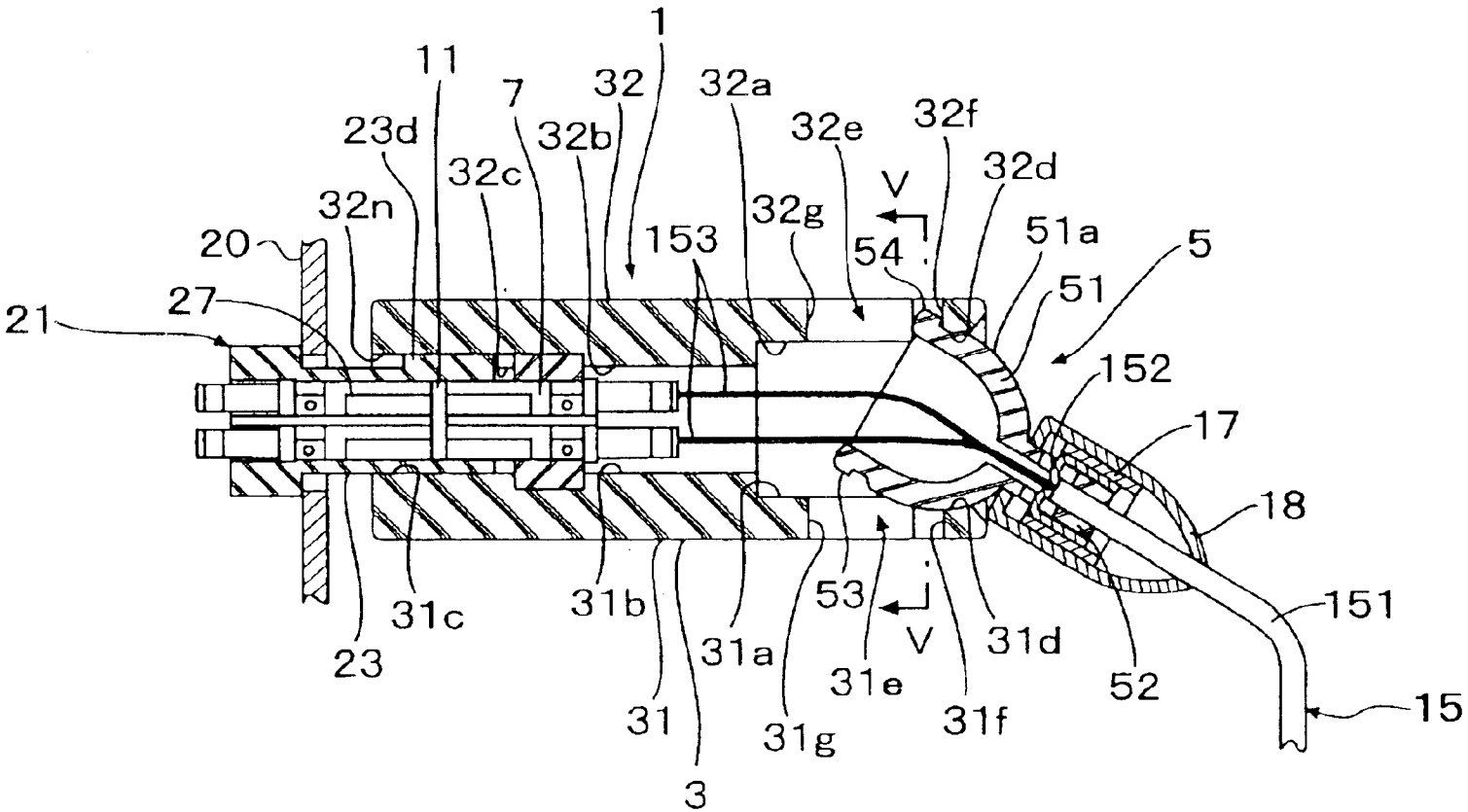
FIG. 4 is a cross-sectional view taken on line III—III of FIG. 2, which shows the optical connector with a flat cable bent in the direction of thickness thereof.
Figure 5:
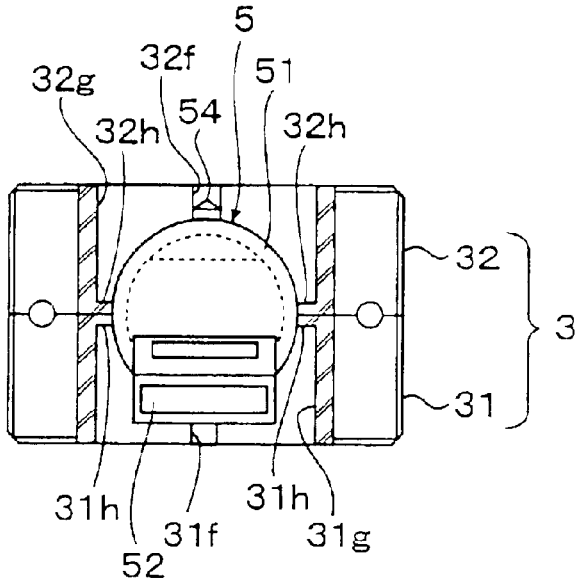
FIG. 5 is a cross-sectional view taken on line V—V of FIG. 4.
Figure 6:
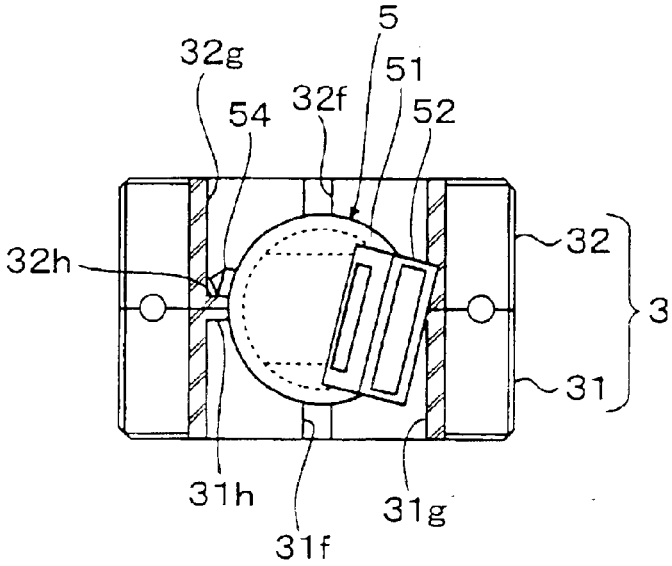
FIG. 6 is a cross-sectional view taken on line V—V of FIG. 4, which shows the optical connector with a surface of the flat cable oriented in a different direction.
Figure 7:
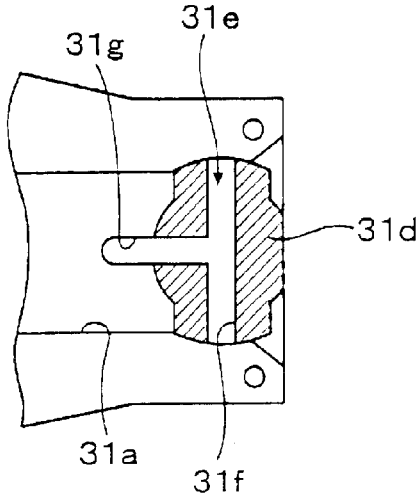
Figure 7:
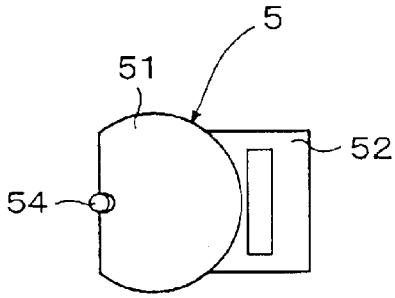
Figure 7:
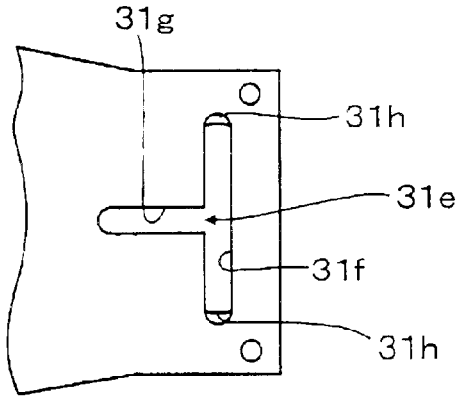

FIG. 1 is a cross-sectional view taken on line II—II of FIG. 3, which shows an optical connector 1 according to a first embodiment of the invention in an unconnected state. FIG. 2 is a cross-sectional view taken on line II—II of FIG. 3. FIG. 3 is a cross-sectional view taken on line III—III of FIG. 2. FIG. 4 is a cross-sectional view taken on line III—III of FIG. 2, which shows the optical connector 1 with a flat cable 15 bent in the direction of thickness thereof. FIG. 5 is a cross-sectional view taken on line V—V of FIG. 4 (however, a cable-holding member 5 is not illustrated in cross section, and the flat cable 15, a clamper 17, and a bushing 18 are omitted). FIG. 6 is a cross-sectional view taken on line V—V of FIG. 4, which shows the optical connector 1 with a surface of the flat cable 15 oriented in a different direction (however, the cable-holding member 5 is not illustrated in cross section, and the flat cable 15, the clamper 17, and the bushing 18 are omitted). FIGS. 7A to 7C show parts of the FIG. 1 optical connector 1. FIG. 7A is a plan view of a slit portion of a lower housing member 31. FIG. 7B is a plan view of the cable-holding member 5. FIG. 7C is a bottom view of the slit portion of the lower housing member 31.

The optical connector 1 includes a housing 3, the cable-holding member 5, and a plug 7.

The housing 3 is formed by the lower housing member 31 and an upper housing member 32.

The lower housing member 31 includes a cable-holding member-accommodating chamber 31*a*, a plug-arranging chamber 31*b*, and a fitting chamber 31*c*. The cable-holding member-accommodating chamber 31*a* has one end formed with a concave portion 31*d*. A hatched area illustrated in FIG. 7A indicates the concave portion 31*d*. The concave portion 31*d* is formed with a slit (slot) 31*e* which is comprised of a transverse slit 31*f* and a longitudinal slit 31*g* (see FIGS. 7A and 7C). The transverse slit 31*f* extends in a direction W of width of the flat cable 15, and is formed in parallel with an axis WS (see FIG. 1) extending in the direction of width of the flat cable 15 to pass through a central point of a spherical portion 51, referred to hereinafter. The longitudinal slit 31*g* is formed in parallel with an axis IS which is orthogonal to the axis WS and extends in a direction I of insertion of the flat cable 15. The transverse slit 31*f* has opposite ends formed with projections 31*h* (see FIGS. 5, 6, and 7C). The plug-arranging chamber 31*b* has a plug 7 received therein such that it is movable in the direction I of insertion of the flat cable 15. Further, the plug-arranging chamber 31*b* has a coil spring, not shown, disposed therein. The coil spring urges the plug 7 toward a mating optical connector 21. The fitting chamber 31*c* receives an end of the optical connector 21 therein.

The lower housing member 31 has opposite side portions each formed with first and second shaft-holding grooves 31*i*, 31*j*. The first and second shaft-holding grooves 31*i*, 31*j* extend along the direction I of insertion of the flat cable 15 and movably holds a shaft 9. The shaft 9 has a knob 9*a* formed at one end thereof, and a male thread 9*b* cut at the other end thereof. A cutout 31*k* is formed between the first shaft-holding groove 31*i* and the second shaft-holding groove 31*j*, and a stopper 11 fitted on the shaft 9 is disposed in the cutout 31*k*. Further, the opposite side portions of the lower housing member 31 are formed with a plurality of bolt insertion holes 31*m* for inserting bolts, not shown, for joining the lower housing member 31 and the upper housing member 32 to each other.

The upper housing member 32 has substantially the same construction as that of the lower housing member 31. More specifically, a cable-holding member-accommodating chamber 32*a*, a plug-arranging chamber 32*b*, a fitting chamber 32*c*, a concave portion 32*d*, a slit 32*e*, projections 32*h*, a first shaft-holding groove, not shown, and a second shaft-holding groove, not shown, a cutout, not shown, and bolt insertion holes, not shown, formed in the upper housing member 32 correspond to the above-mentioned cable-holding member-accommodating chamber 31*a*, plug-arranging chamber 31*b*, fitting chamber 31*c*, concave portion 31*d*, slit 31*e*, projections 31*h*, first shaft-holding groove 31*i*, second shaft-holding groove 31*j*, cutout 31*k*, and bolt insertion holes 31*m*, respectively, formed in the lower housing member 31. To prevent wrong fitting of the mating optical connector 21, the upper housing member 32 is formed with a key groove 32*n* for receiving a key 23*d* formed on a housing 23 of the mating optical connector 21.

The cable-holding member 5 includes the spherical portion 51, a clamp portion 52, and projections 53, 54.

The spherical portion 51 has a hollow spherical shape whose outer surface forms a convex surface 51*a*. The convex surface 51*a* is slidably fitted in the concave portion 31*d* of the lower housing member 31 and the concave portion 32*d* of the upper housing member 32.

The clamp portion 52 is provided at one end of the spherical portion 51 in a manner continuous therewith in the direction I of insertion of the flat cable 15. The clamp portion 52 clamps the flat cable 15 guided into the hollow part of the spherical portion 51. A tension member 152 formed by peeling sheathing 151 of the flat cable 15 is folded and bonded to the clamp portion 52. The clamper 17 is mounted on the portion bonding the tension member 152 to the clamp portion 52, and further the clamper 17 is covered by a bushing 18, whereby when the flat cable 15 is pulled, the pulling force is inhibited from being transmitted to the optical connector 1.

The projection 53 is formed at a lower portion of the spherical portion 51, for entering the slit 31*e* of the lower housing member 31. The projection 54 is formed at an upper portion of the spherical portion 51, for entering the slit 32*e* of the upper housing member 32. An imaginary straight line connecting between the projection 53 and the projection 54 does not pass through the central point of the spherical portion 51. When the projection 53 and the projection 54 are in the longitudinal slit 31*g* and a longitudinal slit 32*g*, respectively, the cable-holding member 5 is permitted to rotate only about the axis WS in the direction W of the width of the flat cable 15. When one of the projections 53, 54 enters the transverse slit 31*f* or *a* transverse slit 32*f*, and the other of them comes out of the slit 31*e* or 32*e*, the cable-holding member 5 is permitted to rotate only about the axis IS in the direction I of insertion of the flat cable 15. As clearly understood from the above description, in the present embodiment, the two slits 31*e*, 32*e* and the two projections 53, 54 form rotation-restricting means for restricting directions of rotations of the cable-holding member 5 such that the cable-holding member 5 can rotate only about the two axes, i.e. the axis WS in the direction W of the width of the flat cable 15, and the axis IS in the direction I of insertion of the flat cable 15.

The plug 7 includes a plug frame 7*a*. The plug frame 7*a* is formed with a recess 7*b* for fixing tape fibers 153 of the flat cable 15. The recess 7*b* is formed with slits 7*c* for being fitted on positioning projections, not shown, provided on the tape fibers 153. Further, the recess 7*b* is formed with holes, not shown, for inserting the tape fibers 153 into the plug frame 7*a*. The plug 7 has an adapter 13 mounted on a front surface thereof.

The mating optical connector 21 includes the housing 23, a stay 26, and a plug 27.

The housing 23 has mounting portions 23*a*, and a fitting portion 23*b*. Each mounting portion 23*a* is provided at one end of the fitting portion 23*b* in a manner continuous therewith, and is formed with a bolt insertion hole 23*c* opposed to a bolt insertion hole 20*a* of a casing 20. The fitting portion 23*b* is inserted into the fitting chambers 31*c*, 32*c* of the housing 3.

The stay 26 has opposite ends thereof formed with female threads 26*a*, 26*b*, respectively. An end of each bolt 28 inserted through the respective bolt insertion holes 23*c*, 20*a* of the mounting portion 23*a* and the casing 20 is screwed into the female thread 26*b*, whereby the housing 23 and the stay 26 are rigidly fixed to the casing 20 in a manner sandwiching the casing 20.

The plug 27 is configured similarly to the plug 7 of the optical connector 1 and includes a plug frame 27*a*. The plug frame 27*a* is formed with a recess 27*b* for fixing tape fibers of a flat cable, not shown, in the casing 20. The recess 27*b* is formed with grooves 27*c* for being fitted on positioning projections provided on the tape fibers. The plug 27 has no adapter mounted thereon.

Next, a description will be given of operation of the above optical connector 1.

To connect the optical connector 1 to the mating optical connector 21, first, the housing 3 of the optical connector 1 is abutted against the housing 23 of the optical connector 21, whereby the fitting portion 23*b* of the housing 23 is inserted into the fitting chambers 31*c*, 32*c* of the housing 3. In this state, the male thread 9*b* of each shaft 9 is screwed into each female thread 26*a* of the stay 26, causing the plug 7 to be abutted against the plug 27 via the adapter 13, whereby the optical connector 1 and the mating optical connector 21 are placed in a state shown in FIGS. 2 and 3 in which they are optically connected to each other.

At this time, as shown in FIG. 3, the surface of the flat cable 15 is oriented vertically as viewed in FIG. 3, and hence to route the flat cable 15 upward or downward as viewed in FIG. 3, it is only necessary to bend the flat cable 15 in the direction T of thickness thereof. At this time, since the cable-holding member 5 is rotatable about the axis WS in the direction W of the width of the flat cable 15, almost no stress is applied to the end of the flat cable 15.

On the other hand, to route the flat cable 15 from the state as shown in FIG. 3 in a direction perpendicular to the plane of the sheet of FIG. 3, first, as shown in FIG. 4, the cable-holding member 5 is rotated about the axis WS along the direction W of width of the flat cable 15, such that the clamp portion 52 of the cable-holding member 5 is lowered, as viewed in FIG. 4. This causes the projection 54 to enter the transverse slit 32*f*, and the projection 53 to be pulled out from the longitudinal slit 31*g*. In this state, the projection 54 can freely move within the transverse slit 32*f* until it abuts against the projection 32*h*, and the projection 53 is not engaged with the longitudinal slit 32*g*, so that the cable-holding member 5 can rotate about the axis IS in the direction I of insertion of the flat cable 15. Accordingly, if the surface of the flat cable 15 is caused to be oriented in a direction of routing of the flat cable 15, the cable-holding member 5 is rotated in accordance with motion of the flat cable 15. When the surface of the flat cable 15 is oriented in the direction of routing of the flat cable 15, the flat cable 15 is bent in the direction T of the thickness thereof, whereby it is possible to route the flat cable 15 in the desired direction.

To remove the optical connector 1 from the mating optical connector 21, first, the shafts 9 are removed from the stay 26. After that, it is only required to remove the housing 3 of the optical connector 1 from the housing 23 of the mating optical connector 21.

Next, a description will be given of the advantageous effects of the present embodiment.

Due to provision of the projections 53, 54 and the slits 31*e*, 32*e*, the cable-holding member 5 of the optical connector 1 can rotate only about the two axes, i.e. the axis WS in the direction W of the width of the flat cable 15 and the axis IS in the direction I of insertion of the flat cable 15. However, if the surface of the flat cable 15 is oriented in the direction of routing of the flat cable by rotating the same about the axis IS, and in this state, the flat cable is bent in the direction T of the thickness thereof, it is possible to route the flat cable 15 in a desired direction. Therefore, in whatever direction a destination of the flat cable 15 to be routed is located, so long as the destination is within reach of the flat cable 15, the routing of the flat cable can be effected by bringing the distal end of the flat cable to the destination.

Further, since the cable-holding member 5 is inhibited from rotating in the direction W of the width of the flat cable 15, the flat cable cannot be bent successfully in the direction W, whereby it is possible to prevent erroneous usage of the flat cable. This makes it possible to prevent breaking of the flat cable 15.

Figure 8:
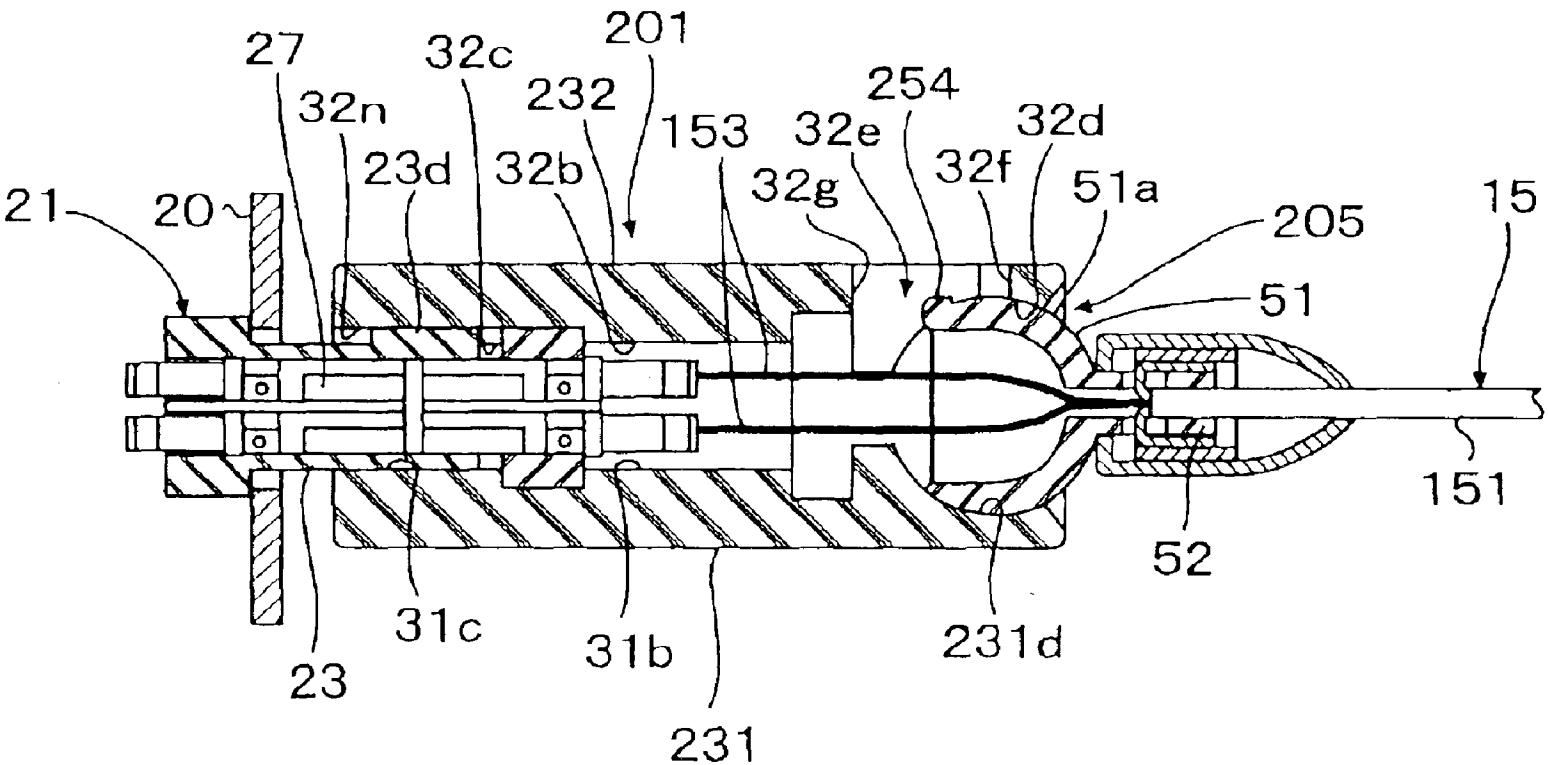
FIG. 8 is a longitudinal cross-sectional view of an optical connector according to a second embodiment of the invention, in a connected state with a flat cable extending straight.
Figure 9:
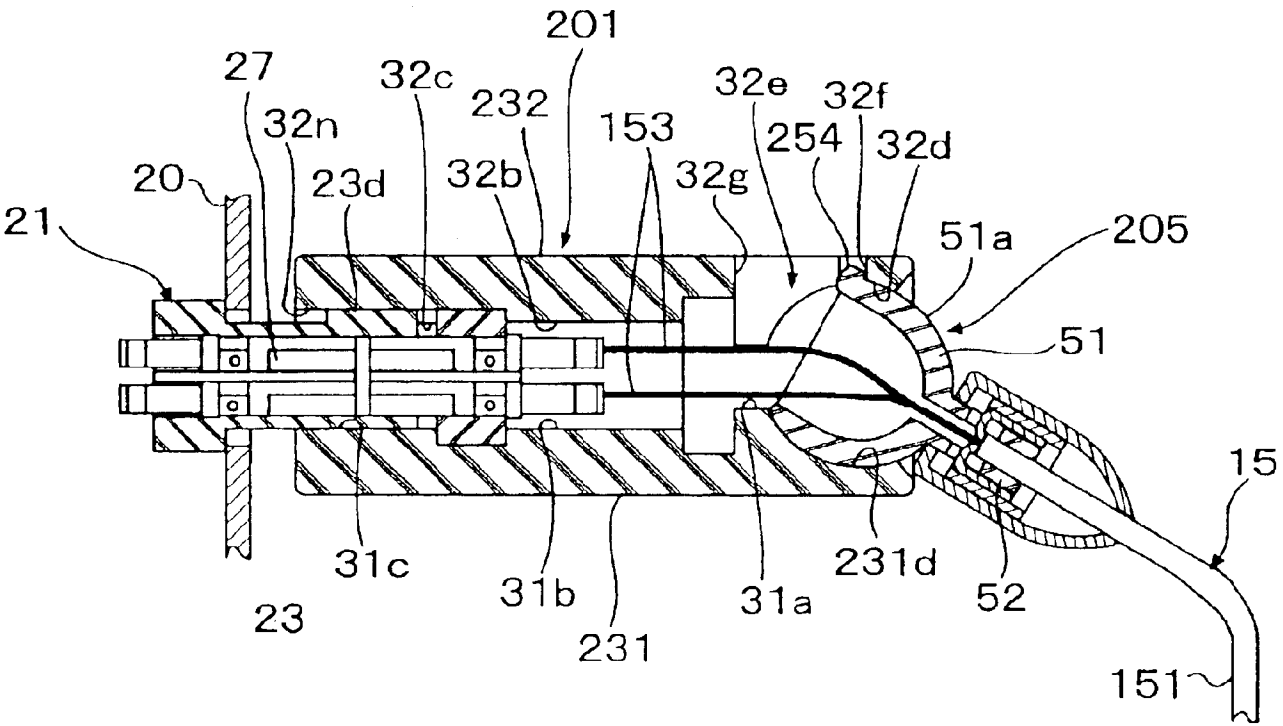
FIG. 9 is a longitudinal cross-sectional view of the FIG. 8 optical connector, with the flat cable bent.

FIG. 8 is a longitudinal cross-sectional view of an optical connector according to a second embodiment of the invention in a connected state with a flat cable extending straight, and FIG. 9 is a longitudinal cross-sectional view of the FIG. 8 optical connector, with the flat cable bent.

Although in the first embodiment, the cable-holding member 5 has the two projections 53, 54 formed thereon, in the present embodiment, a cable-holding member 205 has only one projection 254 formed thereon. Further, the cable-holding member 205 has no projection at a lower portion thereof, as viewed in FIG. 8, and accordingly, a concave portion 231*d* of a lower housing member 231 has no slit formed therein.

According to the second embodiment, rotation-restricting means is simplified in construction to facilitate the machining of the cable-holding member 205 and the lower housing member 231, which contributes to reduction of manufacturing costs of the optical connector.

Although in the first embodiment, there are arranged two projections 53, 54 and two slits 31*e*, 32*e*, and in the second embodiment, there are arranged one projection 254 and one slit 232*e*, the numbers of the projections and the slits are not limited to one or two.

Further, although in the first and second embodiments, the cable-holding members 5, 205 are formed with the projections 53, 54, 254, and the housings 3, 203 with slits 31*e*, 32*e*, and 232*e*, this is not limitative, but the projections may be formed on the housings 3, 203 and the slits may be formed in the cable-holding members 5, 205.

Further, although in the first and second embodiments, the rotation-restricting means are implemented by the projections 53, 54, 254, and the slits 31*e*, 32*e*, 232*e*, this is not limitative, but any other rotation-restricting means may be used so long as it is capable of restricting the directions of rotations of the cable-holding members 5, 205 such that the cable-holding members 5, 205 can rotate only about the two axes, i.e. the axis WS in the direction W of the width of the flat cable 15, and the axis IS in the direction I of insertion of the flat cable 15.

Although in the first and second embodiments, the slits 31*e*, 32*e*, 232*e* are formed in the concave portions 31*d*, 32*d*, 231*d* as the slots, this is not limitative, but arcuate grooves curved according to the radius of the concave surfaces of the concave portions 31*d*, 32*d*, 231*d* may be formed in the surfaces.

Furthermore, although the first and second embodiments are optical connectors, it is also possible to apply the present invention to an electric connector.

It is further understood by those skilled in the art that the foregoing are preferred embodiments of the invention, and that various changes and modifications may be made without departing from the spirit and scope thereof.

What is claimed is:

1. A connector for a flat cable, comprising:

a housing adapted to have an end of the flat cable inserted therein;

a cable-holding member mounted in said housing for holding the flat cable;

a concave portion formed in said housing;

a convex portion formed on said cable-holding member and slidably fitted in said concave portion; and rotation-restricting means for restricting directions of rotations of said cable-holding member such that said cable-holding member must first rotate about a first axis extending in a direction of width of the flat cable to allow said cable-holding member to rotate about a second axis orthogonal to the first axis and extending in a direction of insertion of the flat cable.

2. The connector as claimed in claim 1, wherein said rotation-restricting means comprises:

at least one projection provided on one of said convex portion and said concave portion, and at least one slot provided in the other of said convex portion and said concave portion, for engaging with said at least one projection.

3. The connector as claimed in claim 2, wherein said at least one projection comprises one projection and said at least one slot comprises one slot.

4. The connector as claimed in claim 2, wherein said at least one projection comprises two projections and said at least one slot comprises two slots.

5. The connector as claimed in claim 2, wherein said at least one slot comprises at least one slit.

6. The connector as claimed in claim 2, wherein said at least one slot comprises at least one groove.

7. The connector as claimed in claim 2, wherein each said at least one slot comprises a first slot extending along the first axis, and a second slot extending along the second axis.

8. The connector as claimed in claim 7, wherein said first slot and said second slot are connected to form a continuous T-shaped slot.

9. The connector as claimed in claim 3, wherein said at least one slot comprises at least one slit.

10. The connector as claimed in claim 4, wherein said at least one slot comprises at least one slit.

11. The connector as claimed in claim 3, wherein said at least one slot comprises at least one groove.

12. The connector as claimed in claim 4, wherein said at least one slot comprises at least one groove.

13. The connector as claimed in claim 3, wherein each said at least one slot comprises a first slot extending along the first axis, and a second slot extending along the second axis.

14. The connector as claimed in claim 4, wherein each said at least one slot comprises a first slot extending along the first axis, and a second slot extending along the second axis.

15. The connector as claimed in claim 13, wherein said first slot and said second slot are connected to form a continuous T-shaped slot.

16. The connector as claimed in claim 14, wherein said first slot and said second slot are connected to form a continuous T-shaped slot.

* * * * *